US006221179B1

(12) United States Patent
Yasuhara et al.

(10) Patent No.: US 6,221,179 B1
(45) Date of Patent: Apr. 24, 2001

(54) HOT ROLLED STEEL PLATE TO BE PROCESSED HAVING HYPER FINE PARTICLES, METHOD OF MANUFACTURING THE SAME, AND METHOD OF MANUFACTURING COLD ROLLED STEEL PLATE

(75) Inventors: Eiko Yasuhara, Chiba; Masahiko Morita, Kurashiki; Osamu Furukimi, Chiba; Susumu Okada, Tokyo, all of (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/297,818

(22) PCT Filed: Sep. 10, 1998

(86) PCT No.: PCT/JP98/04078

§ 371 Date: Jun. 22, 1999

§ 102(e) Date: Jun. 22, 1999

(87) PCT Pub. No.: WO99/13123

PCT Pub. Date: Mar. 18, 1999

(30) Foreign Application Priority Data

Sep. 11, 1997 (JP) ..... 9-1246779

(51) Int. Cl.[7] ..... C22C 38/00; C22C 38/02; C21D 7/13; C21D 8/04

(52) U.S. Cl. ..... 148/320; 148/332; 148/333; 148/336; 148/654; 148/648; 148/651; 148/540

(58) Field of Search ..... 148/320, 654, 148/546, 648, 650, 651, 332, 333, 336

(56) References Cited

U.S. PATENT DOCUMENTS 4,466,842 * 8/1984 Yada et al. ..... 148/648
5,200,005 * 4/1993 Najah-Zadeh et al. ..... 148/648

FOREIGN PATENT DOCUMENTS 58-123823 7/1983 (JP) .
58174544 * 10/1983 (JP) .
4-11608 3/1992 (JP) .

* cited by examiner

*Primary Examiner*—Deborah Yee
(74) *Attorney, Agent, or Firm*—Oliff & Berridge, PLC

(57) ABSTRACT

A hot rolled steel sheet with improved formability and producing method therefor, which can be easily produced with general hot strip mills, having less anisotropy of mechanical properties and final ferrite grain diameter of less than 2 μm that could not be achieved by the prior art. The hot rolled steel sheet comprises a ferrite phase as a primary phase, and has an average ferrite grain diameter of less than 2 μm, with the ferrite grains having an aspect ratio of less than 1.5. The hot rolled steel sheet is obtained by carried out a reduction process under a dynamic recrystallization conditions through reduction passes of not less than 5 stands in the hot finish rolling.

30 Claims, 4 Drawing Sheets

$(d - d_0)/d_0$

HOT ROLLED STEEL PLATE TO BE PROCESSED HAVING HYPER FINE PARTICLES, METHOD OF MANUFACTURING THE SAME, AND METHOD OF MANUFACTURING COLD ROLLED STEEL PLATE

TECHNICAL FIELD

This invention relates to a hot rolled steel sheet having ultra fine ferrite grains with an average diameter of less than 2 μm as hot rolled, which exhibits excellent ductility, toughness, fatigue strength and the like, as well as less anisotropy of such properties, and which can be advantageously applied for automobile structural use, home electric appliances structural use, machine structural use or building structural use. This invention further relates to method of producing the hot rolled steel sheet as well as a cold rolled steel sheet with improved formability which is obtained from the hot rolled steel sheet.

BACKGROUND ART

A steel material for automobile structural use or machine structural use is required to exhibit excellent mechanical properties such as strength, formability, toughness and the like. Since these mechanical properties can be effectively improved by refining the grains of the material structure, various methods for producing a material having fine grain structure are being investigated. In the field of high tensile strength steel sheets, in particular, there are intensive needs for steel sheet which is capable of reducing the production cost and exhibiting excellent functional properties. Thus, the target of research and development has been shifted to steel sheet which satisfies the above-mentioned needs. In order to restrain deterioration of ductility, toughness, endurance ratio or the like which may arise from increased tensile strength, it is important to refine the structure of high tensile strength steel. Furthermore, in the field of cold rolled steel sheets for automobile use or the like, it is recognized that refining the structure of the hot rolled steel sheet as the raw material effectively improves the formability, especially the "r-value" or so-called Lankford value. Thus, refining the structure of hot rolled steel sheet is also important particularly when it is used as the raw material for cold rolled steel sheet.

Conventional measures for refining the structure of the materials can be classified into large reduction rolling method, controlled rolling method, controlled cooling method and the like. Among others, a large reduction rolling method for refining the material structure is proposed, for example, in JP-A-58-123823. The refining mechanism of the large reduction rolling method is to promote strain induced transformation from γ phase to α phase due to an increased reduction on austenite grains of the material. While the known method achieves a certain degree of refining, there is a problem associated with the production technology that it is difficult to carry out with general hot strip mills since, for example, not less than 40% of rolling reduction per one pass is needed. Moreover, the refining of the obtained final structure is limited due to the product conditions which are difficult to realize, so that the average grain diameter of the final structure cannot be reduced to less than about 5 μm. Further, the obtained grains are compressed and flattened due to large reduction rolling, thereby giving rise to problems that anisotropy of mechanical properties becomes significant or fracture-absorbed energy is decreased as a result of so-called separation or delamination.

On the other hand, there is known a precipitation strengthening steel sheet comprising Nb or Ti, as a steel sheet which has been subjected to refining by the controlled rolling method or controlled cooling method. The precipitation strengthening steel sheet is strengthened by utilizing the precipitation strengthening action of Nb or Ti, and has ferrite grains which have been refined by utilizing the austenite grains recrystallization inhibition action of Nb or Ti, and also by strain induced transformation to α phase from γ phase of the anrecrystallized deformed austenite grains in finish rolling under a low temperature condition. However, the precipitation strengthening steel sheet has a problem that it has a large anisotropy of mechanical properties. For example, when the steel sheets having a large anisotropy of mechanical properties is applied for automobile use and subjected to press forming process, the effects of the refined structure may not be fully apparent because the forming limit of the material is limited to the property level in the direction of the worst ductile property. This is also the case when the precipitation strengthening material is used for structural materials, wherein the effects of the refined structure may not be fully apparent because the steel sheet has a large anisotropy of toughness or fatigue strength, which are important properties for structural materials. Moreover, the grain diameter of the structure subjected to such refining method as the controlled rolling method or controlled cooling method cannot be reduced to below about 2 μm.

Furthermore, it is known to inhibit the grain growth of the material by rapid cooling immediately after hot rolling (refer, for example, to JP-B-4-11608), though the grain diameter of the structure obtained by such method cannot be reduced to below about 4 μm.

As mentioned above, the grain diameter of the structure of the material which can be achieved by the prior art is limited to 2 μm. In general, the effect of improvement in the mechanical properties by refining the grains is in inverse proportion to a square root of grain diameter. Therefore, while little improvement can be achieved when the grain diameter is not less than 2 μm, a considerable improvement can be achieved if the grain diameter can be successfully reduced to below 2 μm.

DISCLOSURE OF INVENTION

The present invention serves to eliminate the problems involved in the prior art. It is therefore an object of the present invention to provide a hot rolled steel sheet with improved formability, which may be used as a raw material for cold steel sheet, which can be easily produced with general hot strip mills, having less anisotropy of mechanical properties, and final ferrite grain diameter of less than 2 μm that could not be achieved by the prior art. It is another object of the present invention to provide a method of producing the hot rolled steel sheet and a raw material for cold rolled steel sheet.

According to one aspect of the present invention, there is provided a hot rolled steel sheet having ultra fine grains with improved formability, comprising a ferrite phase as a primary phase, and having an average diameter of ferrite grains of less than 2 μm, the ferrite grains having an aspect ratio of less than 1.5.

According to another aspect of the present invention, there is provided a hot rolled steel sheet having ultra fine grains with improved formability, comprising a ferrite phase as a primary phase, and having an average diameter of ferrite grains of less than 2 μm, the ferrite grains having an aspect ratio of less than 1.5, wherein a ratio of the average diameter dm (μm) of the ferrite grains, to an average grain diameter of a secondary phase ds (μm) satisfies a relationship: $0.3<dm/ds<3$.

According to still another aspect of the present invention, there is provided a hot rolled steel sheet having ultra fine grains with improved formability, comprising a ferrite phase as a primary phase, and having an average diameter of ferrite grains of less than 2 μm, the ferrite grains having an aspect ratio of less than 1.5, wherein a ratio of the average diameter dm (μm) of the ferrite grains, to an average grain diameter of a secondary phase ds (μm) satisfies a relationship: 0.3<dm/ds<3, and wherein less than 10% of the grains of the secondary phase are spaced from adjacent grains of the secondary phase by a distance which is less than twice the grain radius of the secondary phase.

Preferably, the hot rolled steel sheet consists essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 3.0 wt %, Mo: 0 to 1.0 wt %, Ni: 0 to 1.0 wt %, and at least one member selected from the group consisting of Ca, REM (rare earth metal), B: 0 to 0.005 wt % in total, the balance being substantially Fe. In this instance, when Mn is included by an amount of not less than 0.5%, the steel sheet may comprise a secondary phase of at least one member selected from the group consisting of martensite, bainite, residual austenite, pearite and acicular ferrite.

The present invention further provides a method of producing a hot rolled steel sheet having ultra fine grains with improved formability, wherein a material for hot rolled steel sheet is produced by melting, and the material is hot rolled immediately thereafter or after having been cooled and heated to a temperature of not more than 1200° C., the hot rolling being carried out as a reduction process under austenite dynamic recrystallization conditions by reduction passes of not less than 5 stands.

Preferably, the hot rolled steel sheet according to the present invention has a bake-hardenability of not less than 100 MPa.

In the method of producing a hot rolled steel sheet according to the present invention, the material of the steel sheet or rolls at the roll stands of a finish rolling equipment may be heated by heating means provided between the roll stands.

The hot rolled steel sheet having ultra fine grains according to the present invention may be used as a raw material for a cold rolled steel sheet, and produced by a method wherein the hot rolled steel sheet is subjected to a cold rolling under reduction of 50 to 90%, and an annealing at a temperature within a range from 600° C. to $Ac_3$ transformation point.

As used herein, "aspect ratio" of the ferrite grain means the ratio of the length of the ferrite grain along the major axis to the length of the ferrite grain along the minor axis, as seen in the cross-section of the ferrite grain. Since the ferrite grains have been elongated in the rolling direction, the aspect ratio of the ferrite grains can be practically substituted by the ratio of the length along the major axis to the length along the minor axis, in a cross-section which is in parallel with the rolling direction.

The average diameter of the ferrite grains as used herein means the average grain diameter as seen in a cross section which is in parallel with the rolling direction, according to commonly accepted practice in the art.

Furthermore, the average grain diameter of the secondary phase according to the invention is determined by measuring the surface area and the number of grains in the structure expect the ferrite phase, with a photomicrograph, dividing the total surface area by the number of such grains to calculate the surface area per grain, and then calculating the diameter of an equivalent circle having the same surface area per grain, which is defined as the average grain diameter of the secondary phase. Similarly, the individual grain diameter of the secondary phase is calculated as the diameter of an equivalent circle having the same area as the grain.

The steel sheet comprising a ferrite phase as a primary phase according to the invention means that a ferrite phase assumes not less than 50% of the entire structure. Further, reference to 0% as the lower limit of Ti and the like indicates that, according to the invention, there may be instances wherein Ti and the like components are not added.

The inventor conducted through research and investigations seeking for solutions of the above-mentioned problems involved in the prior art, and obtained the following recognition. That is to say, it has been found that ultra fine grains of the ferrite phase can be obtained by repeatedly performing the reduction under the austenite dynamic recrystallization conditions in the hot rolling steps. The reduction under the austenite dynamic recrystallization conditions need not be large, so that a satisfactory structure can be obtained in which the ferrite grains have an aspect ratio of less than 1.5, thereby eliminating the problem of anisotropy of the mechanical properties.

A steel sheet according to the invention, wherein the average ferrite grain diameter is less than 2 μm, and the aspect ratio of the ferrite grains is less than 1.5, exhibits not only excellent mechanical properties such as strength, toughness, ductility but also less anisotropy of there mechanical properties, which are due to the presence of fine grains. Moreover, the grain boundary area of the above-mentioned steel sheet is larger than that of the steel sheet wherein the average ferrite grain diameter is not less than 2 μm, so that a large amount of carbon solid solution is trapped on the grain boundary. Accordingly, when the steel product is subjected to baking, the carbon solid solution is diffused into the grains and dislocations are stuck by the carbon solid solution, thereby exhibiting an excellent bake-hardenablity of not less than 100 MPa. Thus, the steel sheet according to the invention can be easily formed into the desired shape, and a high strength can be achieved by a subsequent heat treatment such as baking, and the steel sheet is particularly suitable for automobile use and the like.

Among the steel sheets according to the invention, wherein the average ferrite grain diameter is less than 2 μm and the aspect ratio of the ferrite grains is less than 1.5, it is possible to significantly reduce the difference in grain diameter when the ratio of the average ferrite grain diameter dm (μm) to the average grain diameter ds (μm) of the secondary phase satisfies the relationship of 0.3<dm/ds<3. The steel sheet satisfying the above-mentioned relationship can be deformed uniformly while effectively avoiding occurrence of necking, wrinkles or defective surface properties. Thus, the steel sheet according to the invention has a satisfactory formability and is highly suitable for such forming processes as hole expansion process. Also, the steel sheet according to the invention exhibits excellent fatigue-resistance property and fracture toughness.

The hot rolled steel sheet having the above-mentioned properties, according to the invention, can be widely applied to various fields and uses as, for example, mild steel sheet, steel sheet for automobile structural uses requiring an improved formability as the case may be, steel sheet for home electric appliances or for general structure, and so on. The steel sheet having an improved formability according to the invention can be used for all of these applications.

Therefore, the invention can be applied to a composite structure steel sheet comprising, as the secondary phase, one or more member selected from the group consisting of martensite, bainite, residual austenite, pearlite and acicular ferrite, such as DP (Dual Phase) steel or TRIP (Transformation Induced Plasticity) steel. The invention can also be applied to a single ferrite steel or a steel sheet comprising a structure of ferrite and a small amount of pearlite or cementite. Furthermore, the invention can be applied to a steel sheet for automobile wheels by decreasing the sulfur content so as to be not more than 0.002 wt % and improving hole expansion property and fatigue crack growth stopping property.

Investigations were carried out to ascertain the relationship between the average ferrite grain diameter and the mechanical properties of the hot rolled steel sheets, the result of which is shown in FIG. 1. The investigations were carried out with respect to hot rolled steel sheets comprising various ferrite grain diameter, which were produced by preparing a raw material steel sheet comprising a composition of C: 0.03 wt %, Si: 0.1 wt %, Mn: 0.2 wt %, P: 0.01 wt %, S: 0.003 wt % and Al: 0.04 wt % was heated to 1100° C., subjecting the raw material steel sheet to hot rolling by a rough rolling apparatus under an ordinary condition, and further by a series of seven stands of a finish rolling apparatus under various finish rolling conditions.

Hot rolled steel sheets having an average grain diameter of less than 2 μm were obtained when, during the finish hot rolling, the temperature difference of the steel sheet between the entrance side of the first stand and the exit side of the last stand (i.e., the 7th stand) of hot rolling equipment is not more than 60° C. Similarly, hot rolled steel sheets having an average grain diameter of less than 1 μm were obtained when, during the finish hot rolling, the temperature difference of the steel sheet is not more than about 30° C. Further, the aspect ratio of all the hot rolled steel sheets with an average diameter of less than 2 μm as obtained by the above-mentioned process was less than 1.5.

A bake-hardenability shown in FIG. 1 was measured as an increment amount of tensile stress of the hot rolled steel sheet when it was heated to 170° C. for 20 minutes after addition of 2% of pre-stain.

It can be appreciated from FIG. 1 that the hot rolled steel sheet having an average ferrite grain diameter of less than 2 μm significantly improves various properties as compared with the hot rolled steel sheet having an average ferrite grain diameter of not less than 2 μm. Such a tendency can be recognized not only for the steel sheets of the specific composition subjected to the above-mentioned experiments, but also for the steel sheets of other compositions. It can be further appreciated that the hot rolled steel sheets having an average ferrite grain diameter of not more than 1 μm exhibit further improvement in various properties. For these grounds, according to the invention, the average ferrite grain diameter of the steel sheet is limited to less than 2 μm and the aspect ratio of the ferrite grains of the steel sheet is limited to less than 1.5. Incidentally, investigations were carried out with respect to the average grain diameter of the secondary phase of the steel sheet having an average ferrite grain diameter of less than 2 μm. As a result, with respect to all of the steel sheets having an average ferrite grain diameter of less than 2 μm, it has been found that the dm/ds value was within a range of more than 0.5 to less than 2.

It is preferred that, in the steel sheet comprising a ferrite phase as a primary phase according to the invention, the ratio of the average ferrite grain diameter dm (μm) to the average grain diameter ds (μm) of the secondary phase satisfies the relationship: $0.3<dm/ds<3$. This is because when there is a large difference in the grain diameter between the ferrite as the primary phase and the grains of the secondary phase, a tendency becomes marked wherein the deformation during the forming process becomes non-uniform and the mechanical properties deteriorates. The inventor investigated a preferable range of the ratio of the average ferrite grain diameter dm (μm) to the average grain diameter ds (μm) of the secondary phase. As a result, it has been found that excellent mechanical properties can be achieved and uniform deformation can be caused when the ratio is higher than 0.3 but lower than 3. More preferably, the ratio is within a range of $0.5<dm/ds<2$.

Moreover, it is preferred that the steel sheet having ultra fine grains comprises a secondary phase wherein less than 10% of the grains of the secondary phase are spaced from adjacent grains of the secondary phase by a distance which is less than twice the grain radius of the secondary phase. The inventors conducted various investigations regarding the distribution state of the secondary phase. As a result, it has been found that the mechanical properties, especially the stretch-flanging property, are not sufficiently improved when the grains of the second phase are distributed in band- or line-state (i.e., lamellar state), and further that the grains of the second phase preferably are distributed in island state wherein the grains are relatively isolated from each other without concentration. The distribution form of secondary phase grains may be evaluated by measuring the rate of the grains which are spaced from the nearest grain by a distance which is less than twice the grain radius. When this rate is less than 10%, it is possible to improve the properties of the steel sheet. As for the volume rate of the secondary phase to the entire phases, the preferred range is within 3 to 30%.

The range of the preferred element composition of the steel sheet of the invention will be explained below:

C: 0.01 to 0.3 wt %

C is an inexpensive element and useful for improving the strength. Therefor a necessary amount of C is contained according to the desired steel sheet strength. When the C content is less than 0.01 wt %, grains of the steel sheet become coarse, so that less than 2 μm of the average of the ferrite grain diameter, which is the object of the present invention, is hardly achieved. On the other hand, however, when the C content exceeds 0.3 wt %, the formability and weldablity deteriorate. Therefore, according to the invention, C is preferably contained within the range of about 0.01 to 0.3 wt %. Moreover, when the steel sheet structure is single ferrite or comprises a small amount (not more than 10%) of pearlite or cementite as a secondary phase, it is preferred that the C content is within about 0.01 to 0.1 wt %.

Si: not more than 3.0 wt %

Si improves the strength-elongation balance and contributes to improve the strength as a solid solution strengthening element. Moreover, Si suppresses the ferrite transformation so that it is effective to obtain a structure comprising the desired volume rate of the secondary phase. However, an excessive Si content deteriorates the ductility and the surface properties of steel sheet. Therefore the Si content is not more than 3.0 wt %. More preferably, the Si content is within the ranges of 0.05 to 2.0 wt %. Incidentally, when the steel sheet structure is single ferrite or comprises a small amount (not more than 10%) of pearlite or cementite as a secondary phase, it is preferred that the Si content is not more than 1.0 wt %.

Mn: not more than 3.0 wt %

Mn contributes to refine the grains of the steel sheet by lowering the $Ar_3$ transformation point and promoting the martensite and residual austenite of the secondary phase and thereby improving the strength-ductility balance and the strength-fatigue strength ductility balance. Also, Mn reacts with harmful solid solution sulfur to form harmless MnS. However, an excessive Mn content deteriorates the strength-ductility balance due to hardening of steel. Therefore, the Mn content is not more than 3.0 wt %. When the steel sheet structure comprises a secondary phase of at least one member selected from the group consisting of martensite, bainite, residual austenite, pearite and acicular ferrite, it is preferred that the Mn content is not less than 0.5 wt % in order to obtain the intended structure. More preferably, the Mn content is within the range of 1.0 to 2.0 wt %. On the other hand, when the steel sheet structure is single ferrite or comprises a small amount (not more than 10%) of pearlite or cementite for secondary phase, it is preferred that the Mn content is not more than 2.0 wt %, more preferably, within the range of 0.1 to 1.0 wt %.

P: not more than 0.5 wt %

P is also useful as strengthening element of steel so that a necessary amount of P is contained according to the desired strength of the steel sheet. However, an excessive P content causes segregation at the grain boundaries so that the ductility deteriorates. Therefore, according to the invention, the P content is limited to be not more than 0.5 wt %. It is more preferred that the P content is within the range of 0.005 to 0.2 wt %.

Ti, Nb, V and Mo are useful elements according to the invention by which ultra-fine grains of 2 $\mu$m is obtained due to formation of carbide and/or nitride, and due to refining the grains of the steel sheet. In addition these elements improve the strength due to precipitation strengthening function. Therefore, according to the invention, at least one member selected from the group consisting of Ti, Nb, V and Cr are optionally contained. Among others, Ti positively exhibits the above-mentioned functions even under a low slab heating temperature, because Ti forms carbide and/or nitride at a relatively low temperature, which exist stably in the steel sheet. According to the invention, the contents of these elements are preferably not less than 0.01 wt % in order to fully exhibit the desired functions. On the other hand, when the contents of these elements are excessive, their effects are saturated and the production cost increases. Therefore, the contents of these element are limited to not more than 1.0 wt %, more preferably, not more than 0.5 wt %. When the steel sheet structure is single ferrite or comprises a small amount (not more than 10%) of pearlite or cementite as secondary phase, it is preferred that the contents of these elements are not more than 0.3 wt %, more preferably, not more than 0.1 wt %.

According to the invention, Cr, Cu and Ni may be contained, if necessary, as strengthening elements similar to Mn. When, however, the contents of these elements are excessive, strength-ductility balance deteriorates. Therefore, the contents of these element are limited to not more than 3.0 wt % for Cu, and not more than about 1.0 wt % for Ni and Cr. Moreover, it is preferred to contain these elements by an amount of not less than about 0.01 wt %, in order to sufficiently exhibit the desired functional effects.

Ca, REM and B serve to improve the formability by controlling the shape of sulfide and increasing the grain boundary strength. Therefore these elements may be contained, if necessary. When, however, the contents of these elements are excessive, the pureness or recrystallbity of the steel sheet may be adversely affected. Thus, the contents of these elements are preferably not more than about 50 ppm. In addition, B also serves to lower the aging properties when cold rolled steel sheets are produced by continuous annealing.

The steel sheet according to the invention may have a composite structure which comprises one or more member selected from martensite, bainite, residual austenite, pearlite and acicular ferrite, as a secondary phase, in order to contain not less than 0.5% of Mn within the above-mentioned preferred range of the element composition of the steel sheet. Also, the steel sheet according to the invention may comprise a single ferrite phase or a structure of ferrite and a small amount of pearlite or cementite.

The method of producing the steel sheet according to the invention will be explained below.

A molten steel which has been adjusted to the ranges of the prescribed element composition formed into a rolling material by continuous casting or by ingot casting to rolling in blooming mill, and the so-formed rolling material is then subjected to hot rolling. When the rolling material is subjected to hot rolling, the rolling material may be cooled once and reheated to a temperature of not more than 1200° C. before rolling. Alternatively, the rolling material may be subjected to a direct rolling or hot charge rolling (HCR). Moreover, the slab cast by continuous casting may be directly subjected to hot rolling which may be performed as a thin slab continuous casting method, for example. When the rolling material is reheated prior to the rolling, it is advantageously heated to a low temperature of not more than 1200° C. in order to prevent the grains from becoming coarse. When the rolling material is subjected to a direct rolling, it is preferred to begin the rolling after cooling down the material to a temperature of not more than 1200° C., in order to suppress the grain growth during the hot rolling. The desirable slab heating temperature is not more than 1150° C., in order that the ratio of the average ferrite grain diameter dm ($\mu$m) to the average grain diameter ds ($\mu$m) of the secondary phase satisfies the relationship: $0.3<dm/ds<3$. Moreover, the preferred slab heating temperature is not more than 1100° C., in order to distribute the grains of the second phase in island state. In any case, the lower limit of heating temperature of the rolling material is determined so as to ensure that the desired finish rolling temperature can be preserved, and the lower limit at present is typically about 900° C.

The hot rolling conditions are the most important factors according to the invention. Namely, it is important that the hot rolling is carried out as a reduction process under austenite dynamic recrystallization conditions by reduction passes of not less than five stands in order to obtain the structure having an average ferrite grain diameter of less than 2 $\mu$m, wherein the aspect ratio of the ferrite grains is less than 1.5, and the ratio of the average ferrite grain diameter dm ($\mu$m) to the average grain diameter ds ($\mu$m) of the secondary phase satisfies the relationship: $0.3<dm/ds<3$.

It is effective to subject the rolling material to reduction under austenite dynamic recrystallization conditions by continuous rows of not less than five stands, in order to prevent the temperature drop of the rolling material during the finish rolling as far as possible. On the occasion of the finish rolling, the difference in the steel sheet temperature between the entrance side of the first stand and the exit side of the last stand of the hot rolling equipment is preferably not more than 60° C. and, more preferably, not more than 30° C. The above-mentioned continuous rows of not less than five stands refer to the stands that actually reduce the rolling materials. Thus, for instance, it is possible to arrange non-reducing rolling stand between the actually reducing stands.

When the hot rolling is performed under the austenite dynamic recrystallization conditions at the finish rolling included in the downstream part of the stands, for the purpose of obtaining the desired aspect ratio of the steel sheet, it is preferred that reducing under the austenite dynamic recrystallization conditions is also performed by the last stand of the hot rolling equipment. In addition, for the purpose of positively achieving the reduction under the austenite dynamic recrystallization conditions, it is desirable to perform the reduction at the temperature of the immediately above the $Ar_3$ transformation point.

When the material is reduced under austenite dynamic recrystallization conditions, a large reduction is unnecessary and undesirable since the aspect ratio of the grains deteriorates by a large reduction. A sufficient rolling reduction is 20% at the maximum. The lower limit of the rolling reduction according to the invention is not limited so long as the austenite dynamic recrystallization is achieved, though the rolling reduction of not less than 4% is preferred.

When the austenite dynamic recrystallization conditions are higher in temperature than the finish rolling, it is possible to perform the austenite dynamic recrystallization rolling from the downstream part of the rough rolling to the upstream part of the finish rolling. The preferred reducing conditions are the same as the reduction at the finish rolling in the downstream part of the stands.

The above-mentioned finish rolling may be performed by an ordinary finish rolling equipment under conditions wherein the temperature drop of the steel sheet and the rolling equipment during the hot rolling minimized. However, it is useful to provide heating means between the finish rolling stands, for heating the rolling material or reducing rolls and thereby readily preventing temperature drop of the rolling material during the finish rolling.

Examples of the heating means are shown in FIGS. 2*a* and 2*b*. A high-frequency heating apparatus shown in FIG. 2*a* serves to heat the steel sheet by induced current due to an alternate magnetic field applied to the steel sheet. The heating means according to the invention is not limited to the high-frequency heating apparatus shown in FIG. 2*a*, and it is possible to use an electric heating apparatus to heat the rolls, as shown in FIG. 2*b*, or a heating apparatus by which the rolling material is directly applied with electric current.

Incidentally, during the hot rolling, it is possible to reduce the rolling materials while being applied with lubrication.

The steel sheet which has been subjected to the above-mentioned finish rolling is wound into a coil. The coiling temperature and cooling velocity are not limited, and may be determined in view of the desired properties of the steel sheet. When it is necessary to produce a composite structure steel sheet such as DP steel or TRIP steel, the steel sheet having the desired composite structure can be obtained under conditions wherein the steel sheet is rapidly cooled and coiled so that the cooling curve in the continuous cooling transformation diagram passes the ferrite region at its nose part and also the martensite or bainite region. On the other hand, when it is necessary to produce a single ferrite steel or a steel sheet comprising a structure of ferrite and a small amount of pearlite or cementite, the steel sheet having the desired structure can be obtained under conditions wherein the steel sheet is hot rolled, cooled and coiled so that the cooling curve in the continuous cooling transformation diagram does not pass the region where a secondary phase is produced. Moreover, when it is necessary to produce a steel sheet having a structure in which the grains of the secondary phase are distributed in island state, i.e., less than 10% of the grains of the secondary phase are spaced from adjacent grains of the secondary phase by a distance which is less than twice the grain radius of the secondary phase, it is preferred that the slab heating temperature is not more than 1100° C., the cooling is started as soon as the rolling has been finished, and the cooling velocity is not less than 30° C./s.

In addition, in order to obtain the steel sheet having ultra fine grains according to the invention, it is preferred to perform cooling immediately after the finish rolling, thereby preventing the grains from becoming coarse. More preferred rapid cooling condition is to perform cooling within not more than 0.5 second after the finish rolling, with a cooling velocity of not less than 30° C./s.

The steel sheet satisfying the conditions of the ferrite grain diameter and the aspect ratio according to the invention can be used not only as hot rolled steel sheet for various uses, but also as a raw material for a cold rolled steel sheet. The cold rolled steel sheet according to the invention comprises fine and homogeneous grains so that it is useful as steel sheet with improved formability featured by an excellent r-value.

In order to produce such a cold rolled steel sheet according to the invention, a hot rolled steel sheet is subjected to a cold rolling under a reduction of 50 to 90%, and to a subsequent annealing at a temperature within a range from 600° C. to $Ac_3$ transformation point. When the rolling reduction is less than 50%, an excellent formability is hardly obtained. On the other hand, when the rolling reduction is more than 90%, the effect of improvement in the properties is saturated. When the annealing temperature is less than 600° C. or more than $Ac_3$ transformation point, an excellent formability cannot be obtained in either case. After the annealing, it is possible to perform a rapid cooling which is followed by an averaging treatment. Also, it is possible to perform not only a continuous annealing, but also a box annealing subsequent to the coiling.

BEST MODE FOR CARRYING OUT THE INVENTION

EXAMPLE 1

Figure 1:
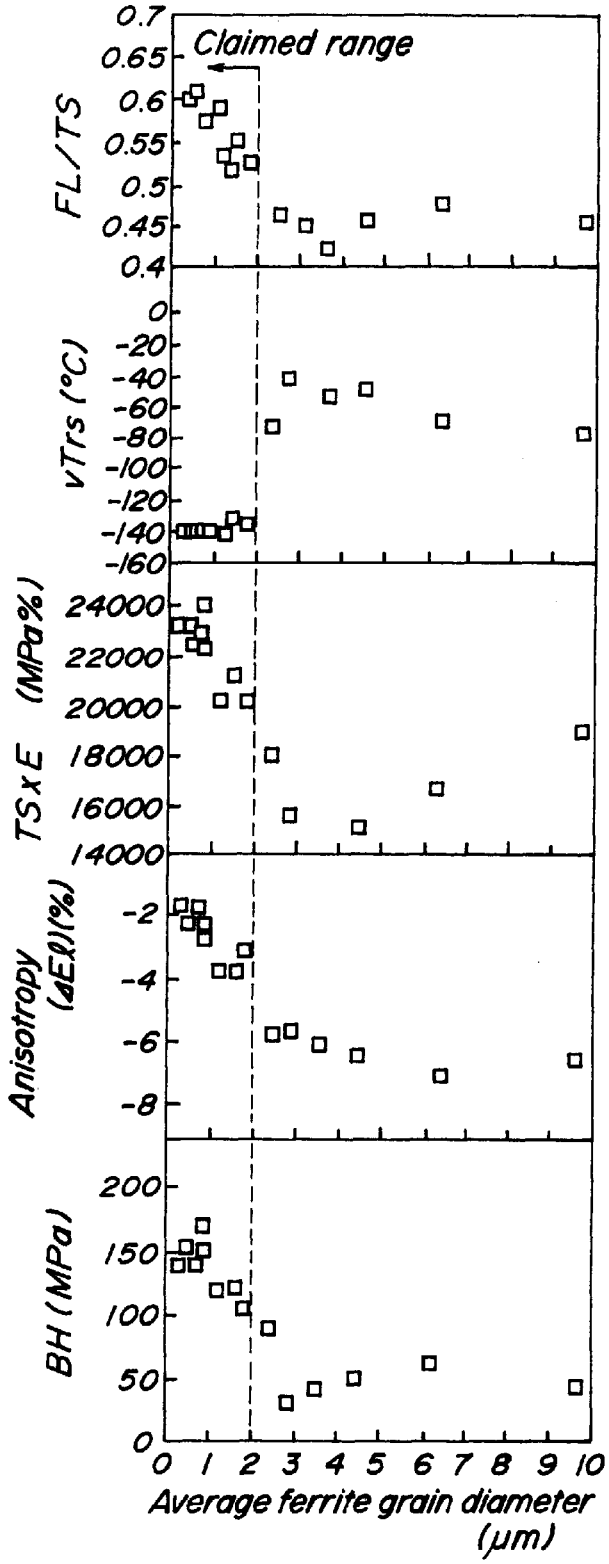
FIG. 1 is a graph showing the relationship between the average ferrite grain diameter and the mechanical properties of various hot rolled steel sheets.
Figure 2A:
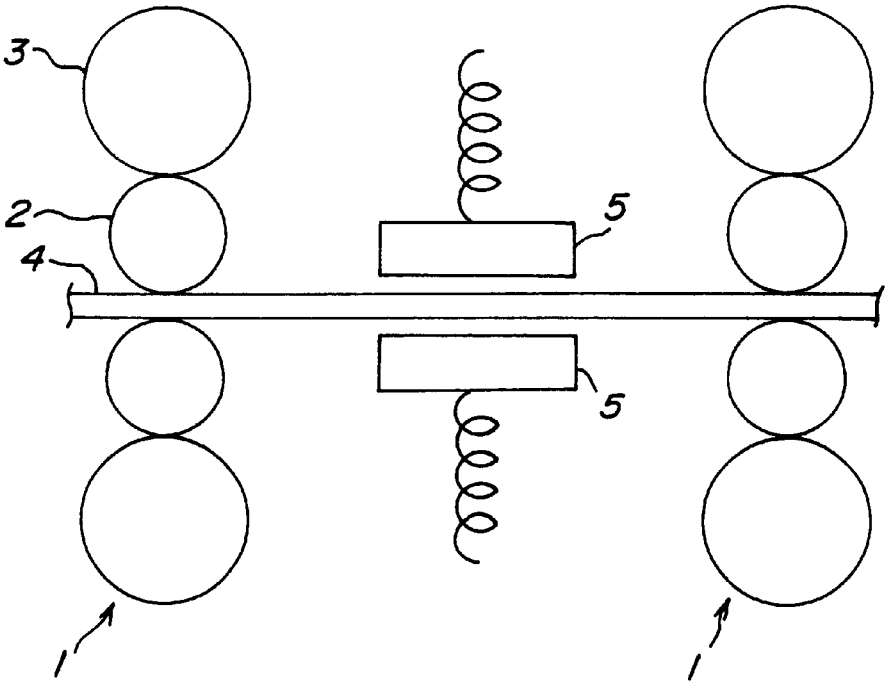
FIGS. 2*a* and 2*b* are explanatory views showing examples of the steel sheet heating means in the finish rolling equipment.
Figure 2B:
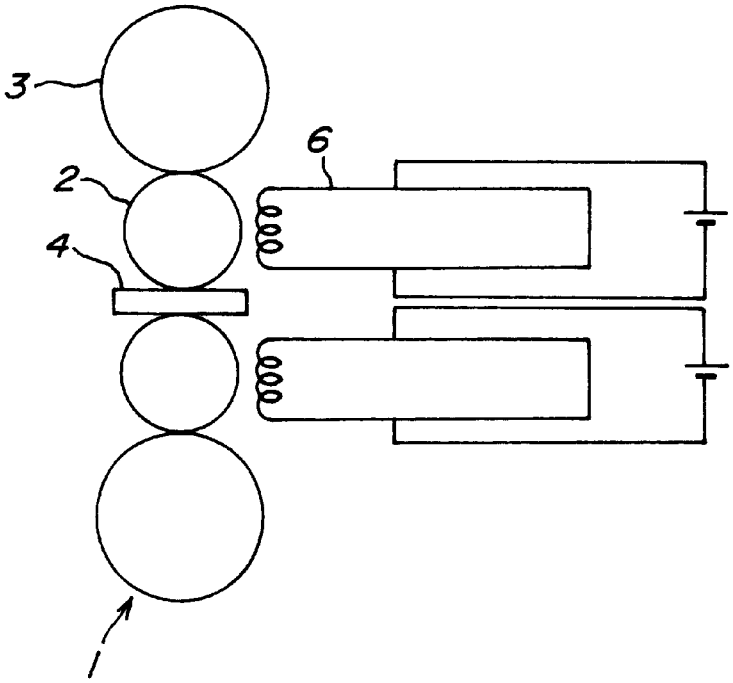

Steel materials having compositions as shown in Table 1 were heated and hot rolled under conditions as shown in Table 2 so as to obtain hot rolled steel sheets. Each steel material was subjected to cooling within not more than 0.3 second after the hot rolling, with a cooling velocity of 50° C./s. Steel material B as shown in Table 1 was reduced by a hot rolling while being applied with lubrication. The mechanical properties of the hot rolled steel sheet are shown in Table 3. These hot rolled steel sheet were further cold rolled and annealed under conditions shown in Table 4. The mechanical properties of the cold rolled steel sheets are also shown in Table 4. The tensile strength of the hot rolled steel sheet according to the invention is not less than 40 kgf/mm$^2$ in all cases. As can be clearly appreciated from Table 3, the steel products according to the invention having a structure in which an average ferrite grain diameter is less than 2 $\mu$m, exhibit excellent strength-elongation balance, endurance ratio, bake-hardening and toughness, and less anisotropy as compared with the comparative steel.

TABLE 1

(wt %)

| Steel | C | Si | Mn | P | Al | S | Others |
|---|---|---|---|---|---|---|---|
| A | 0.040 | 0.02 | 0.2 | 0.03 | 0.01 | 0.010 | B: 0.0005 |
| B | 0.045 | 0.05 | 0.2 | 0.02 | 0.04 | 0.007 | Ti: 0.02, Nb: 0.01 |
| C | 0.090 | 0.08 | 1.25 | 0.01 | 0.04 | 0.010 | Ti: 0.045, Nb: 0.025, Ca: 0.0004 |
| D | 0.060 | 1.2 | 1.5 | 0.01 | 0.05 | 0.003 | Cr: 1.0 |
| E | 0.015 | 1.5 | 1.0 | 0.01 | 0.04 | 0.005 | Cr: 0.2 |
| F | 0.060 | 1.5 | 1.7 | 0.01 | 0.04 | 0.005 | Ti: 0.12 |
| G | 0.060 | 1.2 | 1.2 | 0.01 | 0.03 | 0.004 | — |
| H | 0.003 | 1.5 | 0.5 | 0.02 | 0.03 | 0.003 | REM: 0.0010 |
| I | 0.020 | 1.5 | 1.5 | 0.01 | 0.03 | 0.005 | Ti: 1.5 |
| J | 0.008 | 3.4 | 1.3 | 0.01 | 0.03 | 0.008 | Ti: 0.06 |
| K | 0.100 | 1.3 | 5.2 | 0.02 | 0.03 | 0.010 | Ti: 0.5, Nb: 2 |
| L | 0.015 | 0.01 | 0.3 | 0.01 | 0.01 | 0.008 | — |

TABLE 2

| No. | steel | SRT (° C.) | Entrance temperature of finish rolling (° C.) | Temperature difference in austenite dynamic recrystallization conditions | Number of reducing stands in austenite dynamic recrystallization conditions |
|---|---|---|---|---|---|
| 1 | A | 1150 | 950 | 55° C. | 7 |
| 2 | A | 1100 | 1000 | 29° C. | 7 |
| 3 | A | 1100 | 920 | *80° C. | 4 |
| 4 | A | 1250 | 950 | 70° C. | 6 |
| 5 | B | 1050 | 950 | 46° C. | 7 |
| 6 | B | 1100 | 950 | 28° C. | 7 |
| 7 | C | 1050 | 1000 | 42° C. | 6 |
| 8 | D | 1100 | 1000 | 24° C. | 7 |
| 9 | D | 1000 | 950 | 51° C. | 5 |
| 10 | D | 1250 | 950 | 53° C. | 3 |
| 11 | D | 1100 | 1000 | *80° C. | 2 |
| 12 | E | 1100 | 950 | 46° C. | 5 |
| 13 | F | 1050 | 1000 | 28° C. | 7 |
| 14 | G | 1100 | 1000 | 32° C. | 7 |
| 15 | H | 1100 | 900 | 55° C. | 5 |
| 16 | I | 1050 | 950 | 57° C. | 7 |
| 17 | J | 1050 | 900 | 32° C. | 6 |
| 18 | K | 1100 | 900 | 29° C. | 7 |
| 19 | L | 1150 | 950 | 16° C. | 7 |

*The temperature difference is with respect to five stands, wherein one stand for No. 3 steel and the three stands for No. 11 steel are added on the entrance side, to perform rolling which is not under austenite dynamic recrystallization conditions.

TABLE 3

| No. | Steel | average ferrite grain diameter ($\mu$m) | aspect ratio | volume rate of ferrite grains | structures of secondary phase | dm/ds | TS × EL Mpa % | aniso-trophy ΔE1 (%) | endur-ance ratio (FL/TS) | BH (MPa) | vTrs (° C.) | reference |
|---|---|---|---|---|---|---|---|---|---|---|---|---|
| 1 | A | 1.8 | 1.4 | >90% | cementite | 1.9 | 21200 | −2.5 | 0.53 | 110 | −140 | inventive steel |
| 2 | A | 0.8 | 1.4 | >90% | cementite | 1.3 | 23400 | −1.0 | 0.61 | 130 | −140 | inventive steel |
| 3 | A | 3.5 | 1.9 | >90% | cementite | 0.6 | 18400 | −5.0 | 0.45 | 80 | −95 | relative steel |
| 4 | A | 2.7 | 2.4 | >90% | cementite | 0.1 | 17900 | −6.0 | 0.42 | 90 | −80 | relative steel |
| 5 | B | 1.7 | 1.3 | >90% | pearlite | 0.5 | 21800 | −2.3 | 0.55 | 122 | −140 | inventive steel |
| 6 | B | 0.7 | 1.2 | >90% | pearlite | 1.5 | 24500 | −1.4 | 0.60 | 132 | −140 | inventive steel |
| 7 | C | 1.3 | 1.2 | >70% | bainite + martensite | 1.8 | 24700 | −2.4 | 0.61 | 120 | −140 | inventive steel |
| 8 | D | 0.5 | 1.3 | >70% | martensite | 0.8 | 23700 | −1.4 | 0.58 | 130 | −140 | inventive steel |
| 9 | D | 1.5 | 1.4 | >70% | martensite | 0.9 | 24100 | −2.5 | 0.54 | 125 | −140 | inventive steel |
| 10 | D | 4.6 | 3.1 | >70% | martensite | 0.2 | 15700 | −4.6 | 0.42 | 50 | −60 | relative steel |
| 11 | D | 5.8 | 2.5 | >70% | martensite | 3.2 | 16200 | −4.2 | 0.41 | 70 | −55 | relative steel |
| 12 | E | 1.4 | 1.3 | >70% | residual γ | 2.0 | 22800 | −2.3 | 0.55 | 110 | −140 | inventive steel |
| 13 | F | 0.7 | 1.4 | >70% | martensite + residual γ | 1.9 | 23700 | −1.2 | 0.62 | 136 | −140 | inventive steel |
| 14 | G | 0.9 | 1.4 | >90% | cementite | 0.6 | 24500 | −1.3 | 0.60 | 125 | −140 | inventive steel |
| 15 | H | 5.4 | 2.4 | >90% | cementite | 5.3 | 15100 | −7.2 | 0.41 | 40 | −60 | relative steel |
| 16 | I | 3.1 | 1.8 | >70% | martensite + pearlite | 0.5 | 16010 | −6.4 | 0.42 | 15 | −45 | relative steel |
| 17 | J | 7.2 | 2.2 | >90% | pearlite + bainite | 0.2 | 15700 | −8.9 | 0.46 | 50 | −50 | relative steel |
| 18 | K | 2.8 | 1.9 | >70% | residual γ | 1.5 | 16200 | −6.8 | 0.40 | 56 | −70 | relative steel |
| 19 | L | 0.9 | 1.2 | >99% | — | 1.8 | 25300 | −1.0 | 0.67 | 110 | −140 | inventive steel |

$$\Delta E1 = \frac{E1_{\text{rolling direction}} + E1_{\text{right angle with rolling direction}} - 2\,E1_{45^\circ \text{ with rolling direction}}}{2}$$

TABLE 4

| No. | Steel | SRT (° C.) | entering temperature of finish rolling (° C.) | temperature difference in austenite dynamic recrystallization temperature range | number of reducing stands in austenite dynamic recrystallization temperature range | reduction of cold rolling (%) | annealing temperature (° C.) | r value of cold rolled steel sheet |
|---|---|---|---|---|---|---|---|---|
| 1 | A | 1150 | 950 | 55° C. | 7 | 80 | 800 | 2.1 |
| 4 | A | 1250 | 950 | 70° C. | 6 | 70 | 750 | 1.3 |
| 6 | B | 1100 | 950 | 28° C. | 7 | 30 | 500 | 1.2 |
| 7 | C | 1050 | 1000 | 42° C. | 6 | 75 | 750 | 2.4 |
| 9 | D | 1000 | 950 | 51° C. | 5 | 80 | 800 | 2.3 |
| 11 | D | 1100 | 1000 | 80° C. | 2 | 40 | 600 | 1.5 |
| 12 | E | 1100 | 950 | 46° C. | 5 | 80 | 750 | 2.1 |
| 14 | G | 1100 | 1000 | 32° C. | 7 | 70 | 400 | 1.4 |
| 15 | H | 1100 | 900 | 55° C. | 5 | 70 | 800 | 1.1 |
| 16 | I | 1050 | 950 | 57° C. | 7 | 70 | 500 | 1.0 |
| 18 | K | 1100 | 900 | 29° C. | 7 | 80 | 800 | 1.3 |
| 19 | L | 1050 | 950 | 16° C. | 7 | 85 | 820 | 2.5 |

EXAMPLE 2

Figure 3:
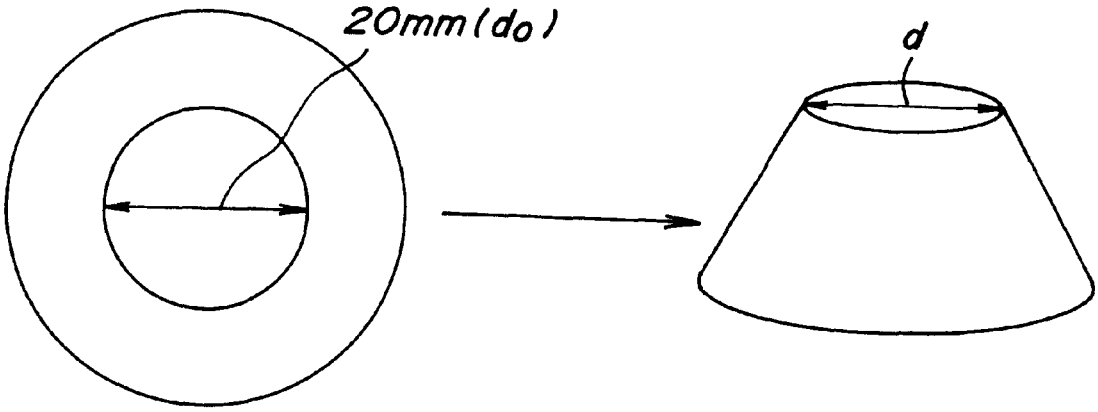
FIG. 3 is an explanatory view showing the measuring method of the enlarging rate.

Hot rolled steel sheets having a structure in which the average ferrite grain diameter is 7 μm (grain diameter range of 6.0 to 8.0 μm) and less than 2 μm (grain diameter range of 0.7 to 1.0 μm) were produced from the material having a composition of C: 0.06 wt %, Si: 0.9 wt %, Mn: 1.3 wt %, P: 0.01 wt % and S: varied within a range of 0.0008 to 0.006 wt %. The secondary phase of the steel sheets were pearite, and the ratios of the average ferrite grain diameter to the average grain diameter of secondary phase were 0.5 to 2 when the average ferrite grain diameter is 2 μm, and 0.1 to 4 when the average ferrite grain diameter is 7 μm. The hot rolled steel sheets having a structure in which the average ferrite grain diameter is less than 2 μm were produced by the method according to the invention. Among the steel sheets according to the invention, two groups were produced by controlling the slab heating temperature and the like. One group has the secondary phase in which less than 10% of the grains satisfy the relationship that they are spaced from the nearest grain by an amount of less than twice the radius of the grain in the secondary phase. Another group has the secondary phase in which 10 to 30% of the grains satisfy the relationship that they are spaced from the nearest grain by an amount of less than twice the radius. These hot rolled steel sheet were subjected to measurement of the enlarging rate wherein, as shown in FIG. 3, specimens with a diameter of 20 mmϕ ($d_0$) were cut out by blanking from a steel sheet and then enlarged by a conical punch having an apical angle is 60° until crack is formed, to subsequently calculate the $(d-d_0)/d_0$ ratio.

Figure 4:
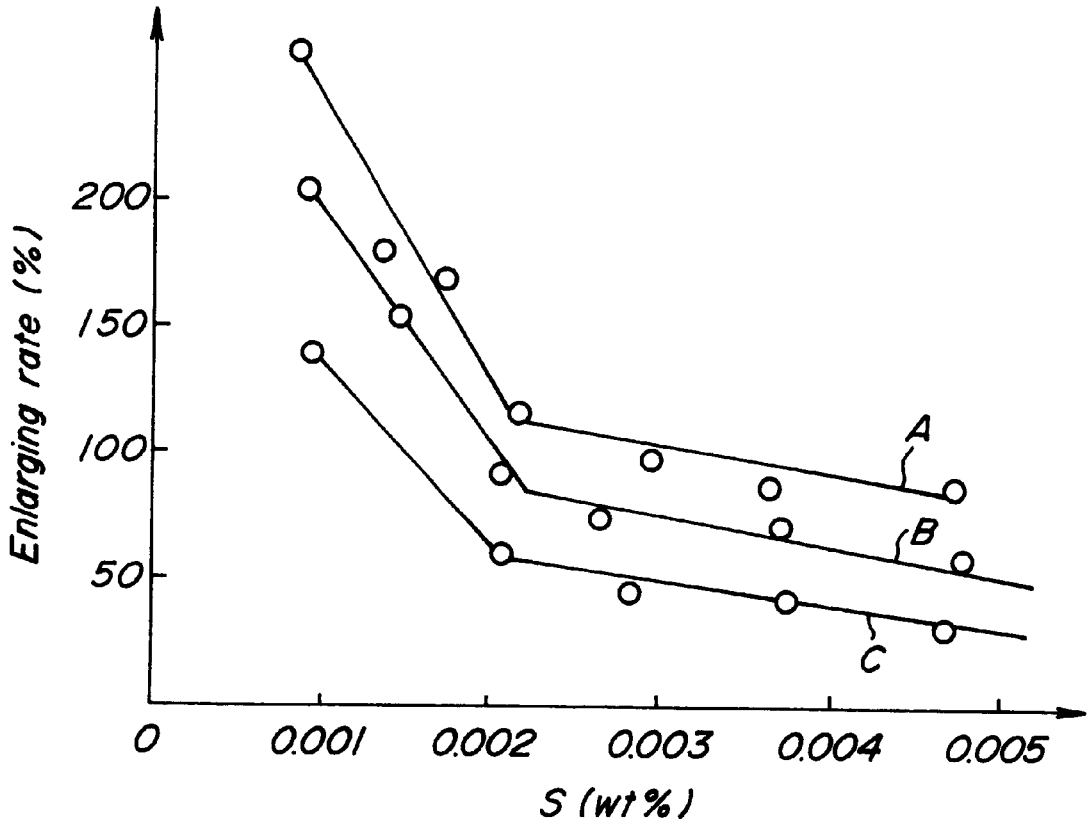
FIG. 4 is an explanatory view showing the relationship between the S content of the steel sheet and the enlarging rate.

FIG. 4 shows the relationship between the S content of the steel sheet and the enlarging rate. The curve A in FIG. 4 shows the group with an average ferrite grain diameter of less than 2 μm, an aspect ratio of 1.3, and dm/ds=1.8 in which the rate of the secondary grains which are spaced from the nearest grain by an amount of less than twice the radius is not more than 10% (8% on average). The curve B in FIG. 4 shows the group with an average ferrite grain diameter of less than 2 μm, an aspect ratio of 1.3, and dm/ds=1.8 in which the rate of the secondary grains which are spaced from the nearest grain by an amount of less than twice the radius is 10 to 30% (23% on average). The curve C in FIG. 4 shows the group with an average ferrite grain diameter of 7 μm and an aspect ratio of 2.5. The groups A and B are steel sheets according to the invention, while the group C are comparative steels.

As can be appreciated from FIG. 4, the steels according to the invention exhibit excellent enlarging rate property. In particular, when S content is decreased to not more than 0.002 wt %, a further improved property is obtained. The enlarging rate can be further improved when the grains of the second phase are distributed in island state. Therefore, the hot rolled steel sheet according to the invention is suitable for the uses where an excellent enlarging property is required, such as for automobile wheels and so on.

EXAMPLE 3

Steel materials having the compositions as shown in Table 5 were heated and hot rolled under conditions as shown in Table 6 so as to obtain hot rolled steel sheets. During the hot rolling, the dynamic recrystallization rolling was performed from the downstream part of the rough rolling to the upstream part of the finish rolling. Each steel material was subjected to cooling within not more than 0.3 second after the hot rolling, with a cooling velocity of 50° C./s. The steel materials C (Nos. 6, 7) as shown in Table 6 were reduced by hot rolling while being applied with lubrication. The mechanical properties of the hot rolled steel sheet are shown in Table 7. The hot rolled sheet of steel B (Nos. 4, 5) and steel D (Nos. 8, 9) were cold rolled with a reduction of 75% and annealed at 750° C. The mechanical properties of the cold rolled steel sheets are also shown in Table 7. The specimen No. 8 (steel D) was heated to 1000° C. and then hot rolled at 800° C. with a reduction of 80%, followed by air cooling to 600° C. and reheating to 850° C., and then subjected to hot rolling at the same temperature of 850° C. and with a reduction of 90% before it was air cooled. The rate of the secondary phase of the steel sheet obtained by the above-mentioned production method was within a range of 3 to 30%. As can be clearly appreciated from Table 7, the steel materials according to the invention having a structure in which the average ferrite grain diameter is less than 2 μm, exhibit excellent strength-elongation balance as compared with the comparative steel. In particular, when the dm/ds ratio is controlled to be within the range of more than 0.3 to less than 3 according to the invention, the steel sheet exhibit further improved endurance ratio, bake-hardening and toughness, and less anisotropy.

TABLE 5

| | elements of steel/mass % | | | | | | |
|---|---|---|---|---|---|---|---|
| steel | C | Si | Mn | P | S | Al | others |
| A | 0.08 | 0.3 | 2.4 | 0.010 | 0.003 | 0.020 | |
| B | 0.13 | 0.5 | 1.8 | 0.010 | 0.004 | 0.020 | Ti: 0.105 |

TABLE 5-continued

| steel | C | Si | Mn | P | S | Al | elements of steel/mass % others |
|---|---|---|---|---|---|---|---|
| C | 0.07 | 0.5 | 2.5 | 0.011 | 0.003 | 0.022 | Ti: 0.13 |
| D | 0.12 | 0.6 | 0.8 | 0.010 | 0.002 | 0.021 | Cr: 0.33, Nb: 0.04 |
| E | 0.08 | 0.7 | 1.4 | 0.012 | 0.004 | 0.020 | Ti: 0.12, Cu: 0.01 |
| F | 0.15 | 0.2 | 1.8 | 0.010 | 0.003 | 0.022 | Ni: 0.31 |
| G | 0.06 | 0.4 | 2.2 | 0.011 | 0.003 | 0.024 | V: 0.24, Ca: 0.002 |
| H | 0.13 | 0.8 | 1.3 | 0.010 | 0.002 | 0.023 | Mo: 0.41 |
| I | 0.11 | 0.4 | 1.2 | 0.012 | 0.003 | 0.022 | B: 0.001 |
| J | 0.07 | 0.6 | 0.7 | 0.011 | 0.002 | 0.024 | Ti: 0.15, REM: 0.002 |

TABLE 6

| No. | steel | SRT (° C.) | Austenite dynamic recrystallization temperature range (° C.) | temperature difference in the austenite dynamic recrystallization conditions | number of reducing stands in austenite dynamic recrystallization conditions |
|---|---|---|---|---|---|
| 1 | A | 1120 | 950~1030 | 50 | 8 |
| 2 | A | 1050 | 920~1000 | 26 | 5 |
| *3 | A | 1100 | 940~1020 | 60 | 4 |
| 4 | B | 1100 | 920~1000 | 35 | 5 |
| 5 | B | 1180 | 920~1000 | 60 | 9 |
| 6 | C | 1000 | 850~930 | 36 | 7 |
| 7 | C | 1250 | 950~1040 | 80 | 6 |
| *8 | D | 1000 | 940~1000 | — | — |
| 9 | D | 1050 | 920~1000 | 38 | 5 |
| 10 | E | 1030 | 920~1000 | 40 | 6 |
| 11 | F | 1100 | 960~1040 | 45 | 7 |
| 12 | G | 1080 | 960~1020 | 40 | 7 |
| 13 | H | 1050 | 950~1050 | 38 | 7 |
| 14 | I | 1000 | 900~980 | 35 | 5 |
| 15 | J | 950 | 840~930 | 36 | 6 |

*3 Reduced at maximum 40%/pass under austenite dynamic recrystallization conditions, and at 30% in the final pass of the finish rolling.
*8 Heated to 1000° C., hot rolled at 800° C. with 80% reduction, air cooled to 600° C., reheated to 850° C., reduced at 850° C. with 90% reduction and cooled.

TABLE 7

| | | ferrite phase | | | secondary phase | | | | mechanical properties | | | | |
|---|---|---|---|---|---|---|---|---|---|---|---|---|---|
| No. | steel | volume rate % | grain diameter dm μm | aspect ratio | structure | grain diameter ds μm | dm/ds | rate of grains that distance to nearest grain is less than two times of radius | Y.S. MPa | T.S. MPa | El. % | TS × El MPa % | λ % |
| 1 | A | 85 | 1.8 | 1.3 | B | 2.0 | 0.90 | 25 | 453 | 545 | 42.0 | 22890 | 55 |
| 2 | A | 80 | 0.8 | 1.4 | M + γ | 1.8 | 0.78 | 8 | 524 | 640 | 37.8 | 24192 | 75 |
| 3 | A | 85 | 1.8 | 2.0 | M + B | 2.9 | 0.62 | 20 | 449 | 540 | 37.5 | 20250 | 40 |
| 4 | B | 75 | 1.7 | 1.4 | P + B | 2.5 | 0.68 | 7 | 487 | 655 | 35.5 | 23253 | 70 |
| 5 | B | 81 | 1.9 | 1.4 | P | 9.5 | 0.20 | 40 | 610 | 780 | 27.6 | 21528 | 40 |
| 6 | C | 76 | 1.6 | 1.3 | B + γ | 1.3 | 1.23 | 9 | 528 | 625 | 36.1 | 22563 | 65 |
| 7 | C | 94 | 8.5 | 3.0 | P | 8.5 | 1.00 | 75 | 493 | 580 | 32.0 | 18560 | 40 |
| 8 | D | 90 | 1.2 | 2.3 | P | 6.5 | 0.18 | 70 | 580 | 650 | 23.2 | 15080 | 30 |
| 9 | D | 80 | 1.6 | 1.4 | P + B | 1.2 | 1.33 | 7 | 627 | 740 | 30.2 | 22348 | 70 |
| 10 | E | 85 | 1.4 | 1.3 | M + γ | 1.1 | 1.27 | 8 | 554 | 680 | 34.5 | 23460 | 70 |
| 11 | F | 80 | 1.5 | 1.3 | B | 2.5 | 0.60 | 8 | 570 | 710 | 32.5 | 22348 | 70 |
| 12 | G | 94 | 1.4 | 1.3 | M + γ | 1.3 | 1.08 | 9 | 557 | 674 | 37.6 | 25342 | 70 |
| 13 | H | 80 | 1.5 | 1.3 | M + B | 2.5 | 0.60 | 7 | 550 | 625 | 35.4 | 22125 | 60 |
| 14 | I | 95 | 1.8 | 1.3 | P | 1 | 1.80 | 8 | 475 | 543 | 42.5 | 23078 | 60 |
| 15 | J | 80 | 1.7 | 1.4 | M + B + γ | 1.5 | 1.13 | 9 | 588 | 680 | 35.5 | 24140 | 60 |

TABLE 7-continued

| No. | mechanical properties | | | | | reference |
|---|---|---|---|---|---|---|
| | anisotrophy ΔEl | endurance ratio FL/TS | vTrs ° C. | BH MPa | r value of cold rolled steel sheet | |
| 1 | −2.4 | 0.5 | −140 | 120 | — | inventive steel |
| 2 | −1.5 | 0.6 | −140 | 135 | — | inventive steel |
| 3 | −7.2 | 0.4 | −90 | 100 | — | relative steel |
| 4 | −1.1 | 0.6 | −140 | 115 | 2.2 | inventive steel |
| 5 | −2.2 | 0.4 | −110 | 100 | 2.0 | inventive steel |
| 6 | −2.3 | 0.6 | −140 | 120 | — | inventive steel |
| 7 | −8.8 | 0.4 | −70 | 50 | — | relative steel |
| 8 | −3.1 | 0.4 | −70 | 95 | 1.4 | prior steel |
| 9 | −1.4 | 0.6 | −140 | 120 | 2.2 | inventive steel |
| 10 | −2.2 | 0.6 | −140 | 125 | — | inventive steel |
| 11 | −2.1 | 0.6 | −140 | 125 | — | inventive steel |
| 12 | −2.2 | 0.6 | −140 | 125 | — | inventive steel |
| 13 | −2.4 | 0.6 | −140 | 120 | — | inventive steel |
| 14 | −1.8 | 0.5 | −140 | 110 | — | inventive steel |
| 15 | −2.2 | 0.6 | −140 | 110 | — | inventive steel |

$\lambda = (d - d_0)/d_0 \times 100$
$d_0$; diameter when blanking
d; diameter when cracking is occur
ΔEl = {rolling direction + right angle with rolling direction)/2} − 45° with rolling direction

INDUSTRIAL APPLICABILITY

The invention provides a hot rolled steel sheet with improved formability and a raw material for a cold rolled steel sheet, having ultra fine ferrite grains with an average diameter of less than 2 μm. The steel sheet according to the invention exhibits excellent mechanical properties and less anisotropy, and can be readily produced with general hot strip mills and advantageously applied to industrial uses.

What is claimed is:

1. A hot rolled steel sheet having ultra fine grains with improved formability, comprising a ferrite phase as a primary phase, and having an average diameter of ferrite grains of less than 2 μm, said ferrite grains having an aspect ratio of less than 1.5.

2. A hot rolled steel sheet having ultra fine grains with improved formability, comprising a ferrite phase as a primary phase, and having an average diameter of ferrite grains of less than 2 μm, said ferrite grains having an aspect ratio of less than 1.5, wherein a ratio of the average diameter dm (μm) of the ferrite grains, to an average grain diameter of a secondary phase ds (μm) satisfies a relationship: 0.3<dm/ds<3.

3. A hot rolled steel sheet having ultra fine grains with improved formability, comprising a ferrite phase as a primary phase, and having an average diameter of ferrite grains of less than 2 μm, said ferrite grains having an aspect ratio of less than 1.5, wherein a ratio of the average diameter dm (μm) of the ferrite grains, to an average grain diameter of a secondary phase ds (μm) satisfies a relationship: 0.3<dm/ds<3, and wherein less than 10% of the grains of the secondary phase are spaced from adjacent grains of the secondary phase by a distance which is less than twice the grain radius of the secondary phase.

4. The hot rolled steel sheet according to claim 1, consisting essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 3.0 wt %, Mo: 0 to 1.0 wt %, Ni: 0 to 1.0 wt %, and at least one member selected from the group consisting of Ca, REM, B: 0 to 0.005 wt % in total, the balance being substantially Fe.

5. The hot rolled steel sheet according to claim 1, consisting essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 3.0 wt %, Mo: 0 to 1.0 wt %, Ni: 0 to 1.0 wt %, and at least one member selected from the group consisting of Ca, REM, B: 0 to 0.005 wt % in total, the balance being substantially Fe, said steel sheet comprising a secondary phase of at least one member selected from the group consisting of martente, bainite, residual austenite, pearite and acicular ferrite.

6. A hot rolled steel sheet having ultra fine grains with improved formability produced by conducting a hot rolling as a reduction process under austenite dynamic recrystallization conditions through reduction passes of not less than 5 stands when a material for hot rolled steel sheet is produced by melting and hot rolled immediately after melting or after being cooled and heated to a temperature of not more than 1200° C., which comprises a ferrite phase as a primary phase having an average diameter of ferrite grains of less than 2 μm and an aspect ratio of ferrite grains of less than 1.5.

7. A hot rolled steel sheet having ultra fine grains with improved formability produced by conducting a hot rolling as a reduction process under austenite dynamic recrystallization conditions through reduction passes of not less than 5 stands when a material for hot rolled steel sheet is produced by melting and hot rolled immediately after melting or after being cooled and heated to a temperature of not more than 1200° C., which comprises a ferrite phase as a primary phase having an average diameter of ferrite grains of less than 2 μm and an aspect ratio of ferrite grains of less than 1.5, wherein a ratio of the average diameter dm (μm) of the ferrite grains, to an average grain diameter of a secondary phase ds (μm) satisfies a relationship: 0.3<dm/ds<3.

8. A hot rolled steel sheet having ultra fine grains with improved formability produced by conducting a hot rolling as a reduction process under austenite dynamic recrystallization conditions through reduction passes of not less than 5 stands when a material for hot rolled steel sheet is produced by melting and hot rolled immediately after melting or after being cooled and heated to a temperature of not more than 1200° C., which comprises a ferrite phase as a primary phase having an average diameter of ferrite grains of less than 2 μm and an aspect ratio of ferrite grains of less than 1.5, wherein a ratio of the average diameter dm (μm) of the ferrite grains, to an average grain diameter of a secondary phase ds (μm) satisfies a relationship: 0.3<dm/ds<3, and wherein less than 10% of the grains of the secondary phase are spaced from adjacent grains of the secondary phase by a distance which is less than twice the grain radius of the secondary phase.

9. The hot rolled steel sheet according to claim 6, wherein said hot rolling as a reduction process under austenite dynamic recrystallization conditions is carried out at a rolling reduction of not less than 4% but not more than 20% per one stand.

10. The hot rolled steel sheet according to claim 7, wherein said hot rolling as a reduction process under austenite dynamic recrystallization conditions is carried out at a rolling reduction of not less than 4% but not more than 20% per one stand.

11. The hot rolled steel sheet according to claim 8, wherein said hot rolling as a reduction process under austenite dynamic recrystallization conditions is carried out at a rolling reduction of not less than 4% but not more than 20% per one stand.

12. The hot rolled steel sheet according to claim 6, consisting essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 1.0 wt %, Mo: 0 to 1.0 wt %, Ni: 0 to 1.0 wt %, and at least one member selected from the group consisting of Ca, REM, B: 0 to 0.005 wt % in total, the balance being substantially Fe.

13. The hot rolled steel sheet according to claim 7, consisting essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 1.0 wt %, Mo: 0 to 1.0 wt %, Ni: 0 to 1.0 wt %, and at least one member selected from the group consisting of Ca, REM, B: 0 to 0.005 wt % in total, the balance being substantially Fe.

14. The hot rolled steel sheet according to claim 8, consisting essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 1.0 wt %, Mo: 0 to 1.0 wt %, Ni: 0 to 1.0 wt %, and at least one member selected from the group consisting of Ca, REM, B: 0 to 0.005 wt % in total, the balance being substantially Fe.

15. The hot rolled steel sheet according to claim 9, consisting essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 1.0 wt %, Mo: 0 to 1.0 wt %, Ni: 0 to 1.0 wt %, and at least one member selected from the group consisting of Ca, REM, B: 0 to 0.005 wt % in total, the balance being substantially Fe.

16. The hot rolled steel sheet according to claim 6, consisting essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 1.0 wt %, Mo: 0 to 1.0 wt %, Ni: 0 to 1.0 wt %, and at least one member selected from the group consisting of Ca, REM, B: 0 to 0.005 wt % in total, the balance being substantially Fe, said steel sheet comprising a secondary phase of at least one member selected from the group consisting of martensite, bainite, residual austenite, pearite and acicular ferrite.

17. The hot rolled steel sheet according to claim 7, consisting essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 1.0 wt %, Mo: 0 to 1.0 wt %, Ni: 0 to 1.0 wt %, and at least one member selected from the group consisting of Ca, REM, B: 0 to 0.005 wt % in total, the balance being substantially Fe, said steel sheet comprising a secondary phase of at least one member selected from the group consisting of martensite, bainite, residual austenite, pearite and acicular ferrite.

18. The hot rolled steel sheet according to claim 8, consisting essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 1.0 wt %, Mo: 0 to 1.0 wt %, Ni: 0 to 1.0 wt %, and at least one member selected from the group consisting of Ca, REM, B: 0 to 0.005 wt % in total, the balance being substantially Fe, said steel sheet comprising a secondary phase of at least one member selected from the group consisting of martensite, bainite, residual austenite, pearite and acicular ferrite.

19. The hot rolled steel sheet according to claim 9, consisting essentially of C: 0.01 to 0.3 wt %, Si: not more than 3.0 wt %, Mn: not more than 3.0 wt %, P: not more than 0.5 wt %, at least one member selected from the group consisting of Ti: 0 to 1.0 wt %, Nb: 0 to 1.0 wt %, V: 0 to 1.0 wt %, Cr: 0 to 1.0 wt %, Cu: 0 to 1.0 wt %, Mo: 0 to 1.0 wt %, Ni: 0 to 1.0 wt %, and at least one member selected from the group consisting of Ca, REM, B: 0 to 0.005 wt % in total, the balance being substantially Fe, said steel sheet comprising a secondary phase of at least one member selected from the group consisting of martensite, bainite, residual austenite, pearite and acicular ferrite.

20. A hot rolled steel sheet according to claim 6, having a bake-hardenability of not less than 100 MPa.

21. A hot rolled steel sheet according to claim 7, having a bake-hardenability of not less than 100 MPa.

22. A hot rolled steel sheet according to claim 8, having a bake-hardenability of not less than 100 MPa.

23. A hot rolled steel sheet according to claim 9, having a bake-hardenability of not less than 100 MPa.

24. A hot rolled steel sheet according to claim 10, having a bake-hardenability of not less than 100 MPa.

25. A hot rolled steel sheet according to claim 11, having a bake-hardenability of not less than 100 MPa.

26. A method of producing a hot rolled steel sheet having ultra fine grains with improved formability, wherein a material for hot rolled steel sheet is produced by melting, and said material is hot rolled immediately thereafter or after having been cooled and heated to a temperature of not more than 1200° C., said hot rolling being carried out as a reduction process under austenite dynamic recrystallization conditions by reduction passes of not less than 5 stands.

27. The method according to claim 26, wherein said hot rolling as a reduction process under austenite dynamic recrystallization conditions is carried out at a rolling reduction of not less than 4% but not more than 20% per one stand.

28. The method according to claim 26, wherein the material of the steel sheet or rolls at the roll stands of a finish rolling equipment are heated by heating means provided between said roll stands.

29. A hot rolled steel sheet as a raw material for a cold rolled steel sheet, having ultra fine grains and comprising structure and composition according to claim 6.

30. A method of producing a cold rolled steel sheet, wherein a hot rolled steel sheet according to claim 29 is cold rolled under reduction of 50 to 90%, and annealed at a temperature within a range from 600° C. to $Ac_3$ transformation point.

* * * * *